US006302611B1

(12) United States Patent
de Gier et al.

(10) Patent No.: US 6,302,611 B1
(45) Date of Patent: Oct. 16, 2001

(54) CONNECTING PIECE

(75) Inventors: Gertrudis M. G. de Gier, Velddriel; Adrianus M. C. M. Van Doornmalen, Ammerzoden, both of (NL)

(73) Assignee: Metaalwarenfabriek A.P. Verachtert B.V., s-Hertogenbosch (NL)

( * ) Notice: Subject to any disclaimer, the term of this patent is extended or adjusted under 35 U.S.C. 154(b) by 0 days.

(21) Appl. No.: 09/504,762

(22) Filed: Feb. 15, 2000

(30) Foreign Application Priority Data

Feb. 23, 1999 (NL) ..... 1011374

(51) Int. Cl.[7] ..... F16D 1/00

(52) U.S. Cl. ..... 403/24; 403/109.1; 403/109.3; 414/723; 37/468

(58) Field of Search ..... 248/637, 647; 37/468, 903; 414/723; 403/408.1, 24, 52, 81, 82, 83, 112, 109.1, 109.3, 110, 107

(56) References Cited

U.S. PATENT DOCUMENTS 4,067,467 * 1/1978 Datta et al. ..... 414/723
5,179,794 * 1/1993 Ballinger ..... 414/723
5,494,396 * 2/1996 Geier et al. ..... 414/723
5,890,871 * 4/1999 Woerman ..... 37/468

FOREIGN PATENT DOCUMENTS

521560 * 1/1993 (EP) .

* cited by examiner

*Primary Examiner*—Lynne H. Browne
*Assistant Examiner*—Aaron M. Dunwoody
(74) *Attorney, Agent, or Firm*—Oblon, Spivak, McClelland, Maier & Neustadt, P.C.

(57) ABSTRACT

The invention relates to a connecting piece which can be pivotally connected both to the jib of an excavator and to a setting cylinder connected to a jib, and which is intended for linking up a tool, such as an excavator bucket, for example, to the end of the jib. A connecting wedge is connected to the connecting piece, in which two pins extending perpendicularly to the longitudinal direction of the wedge and being guided in the connecting piece are mounted. An adjusting element is connected to the connecting piece, by means of which the connecting wedge can be moved in a direction transversely to its longitudinal direction. The connecting piece comprises a screw spindle, which is journalled in the connecting wedge and which is screw into a nut-shaped member connected to the connecting piece.

8 Claims, 2 Drawing Sheets

CONNECTING PIECE

BACKGROUND OF THE INVENTION

The invention relates to a connecting piece which can be pivotally connected both to the jib of an excavator and to a setting cylinder connected to a jib, and which is intended for linking up a tool, such as an excavator bucket, for example, to the end of the jib, wherein a connecting wedge is connected to the connecting piece, in which two pins extending perpendicularly to the longitudinal direction of the wedge and being guided in the connecting piece are mounted, whilst an adjusting element is connected to the connecting piece, by means of which the connecting wedge can be moved a specific distance with respect to the connecting piece in a direction parallel to the longitudinal direction of said pins.

A connecting piece of this kind is known from European patent No. 0 521 560. In this prior art construction, a hydraulic setting cylinder is connected to the connecting piece for moving the connecting wedge. This prior art construction is satisfactory per se, but in some cases it is desirable to have a connecting piece wherein the connecting wedge can be adjusted by mechanical means, for example when the connecting piece is used in a crane or the like which does not comprise means by which the hydraulic setting cylinder can be actuated.

SUMMARY OF THE INVENTION

According to the invention, the connecting piece comprises a screw spindle, which is rotatable about is central axis and which is journalled in the connecting wedge in such manner as to be incapable of movement in its longitudinal direction and which is screwed into a nut-shaped member connected to the connecting piece, which nut-shaped member can spring in the longitudinal direction of the screw spindle with respect to the connecting piece.

In this manner a connecting piece can be realised by means of which the connecting wedge can be locked in position, using the screw spindle, whilst an adequate clamping down of the connecting wedge will be maintained also after prolonged use, due to the fact that the nut-shaped member is spring-mounted.

The various parts, such as the connecting wedge and the like, will remain connected to the connecting piece when the connecting piece is disconnected from the tool, so that there will be no danger of parts being lost.

Another advantage of the construction according to the invention is the fact that the same connecting piece can be used both for the construction comprising a hydraulic setting cylinder as disclosed in European patent No. 0 521 560 and for the construction comprising the screw spindle. This is advantageous not only from a manufacturing point of view, but it also enables the user to change the construction of the connecting piece in a simple manner, if desired.

In order to be able to clamp down the connecting wedge quickly by means of the screw spindle, the screw spindle will preferably be formed with screw thread of relatively large pitch. This may lead to the screw spindle working loose, however, in particular when the tool that is linked to the jib of the excavator is a vibrator. In order to prevent this, a locking member is fitted, by means of which the screw spindle can be locked against rotation. Preferably, said locking member is mounted on the connecting wedge, so that the locking member will be readily accessible.

BRIEF DESCRIPTION OF THE INVENTION

The invention will now be explained in more detail with reference to the appended figures, which show an embodiment of the construction according to the invention.

DESCRIPTION OF THE PREFERRED EMBODIMENT

Figure 1:
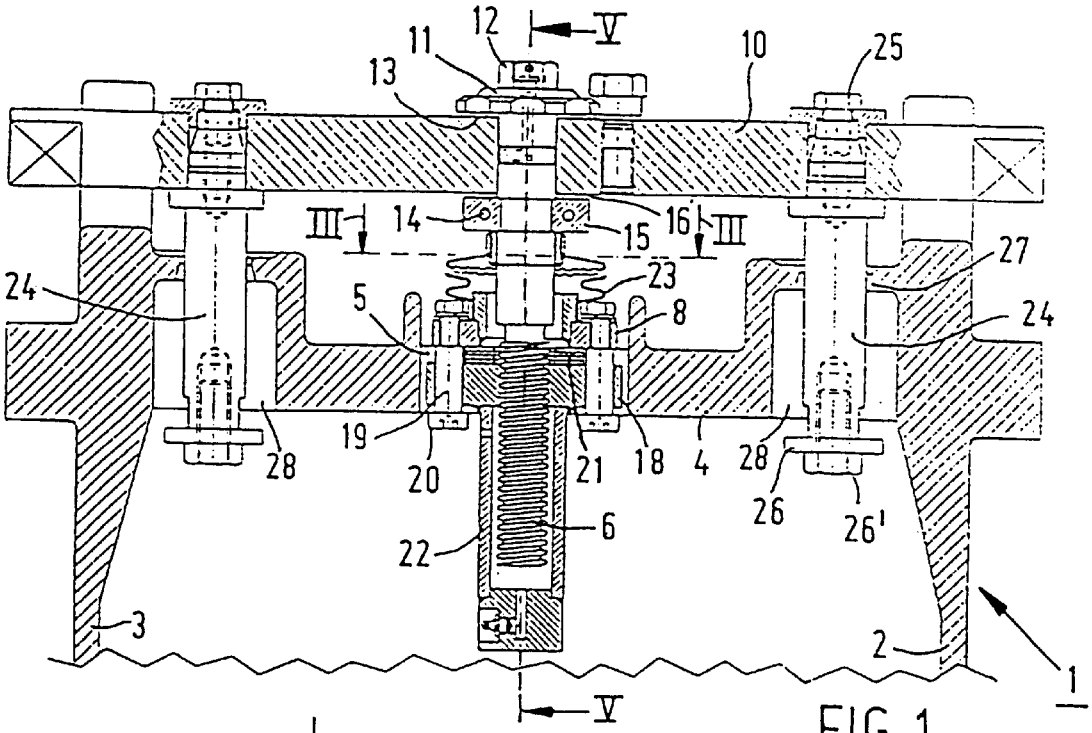
FIG. 1 is a schematic sectional view of a part of the connecting piece, showing the connecting wedge in the position which the various parts will take up in the clamped-down position on a tool.

The construction and the use of a connecting piece which can be connected to the end of the jib of an excavator or the like with a view to quickly linking up a tool, such as an excavator bucket or the like, to the end of the jib is described in great detail in the aforesaid European patent No. 0 521 560, whose contents are considered to be incorporated herein by this reference, so that it will not be necessary to discuss this in detail herein.

Connecting piece 1 comprises two or more less plate-shaped parts 2 and 3 extending substantially parallel to each other, which are interconnected by means of a fixed link 4. A hole 5 is formed in the center of said fixed link, through which a screw spindle 6 extends. Said screw spindle 6 extends through a bush 7, which is attached to a plate 8, which is secured to fixed link 4 near hole 5 by means of bolts 9. Screw spindle 6 is rotatably journalled with one end in a hole which is formed in the center of a connecting wedge 10.

On the side of the connecting wedge remote from fixed link 4, the screw spindle 6 comprises a plate-shaped part 11 and a part 12 projecting therefrom, which is shaped in the form of a bolt head.

Plate-shaped part 11 abuts against a side of connecting wedge 10 via an interposed slide plate 13. A locking ring 15 is secured to screw spindle 6, on the side of the connecting wedge 10 remote from the plate-shaped part, by means of bolts 14, whilst a slide ring 16 is disposed between said locking ring and the lateral surface of the connecting wedge.

It will be apparent that in this manner the screw spindle 6 is rotatably journalled in the connecting wedge and locked against sliding movement in its longitudinal direction with respect to the connecting wedge.

An L-shaped passage 17 is formed in the part of the screw spindle that is present within the connecting wedge, which passage is connected to a lubricating nipple mounted in part 12 with a view to supplying grease to the bore in the connecting wedge 10 in which the screw spindle 6 is rotatably journalled.

The screw spindle is screwed into a nut-shaped member 18 on the side remote from connecting wedge 10 of the plate 8 that is fixed to the connecting piece 1. Said nut-shaped member is capable of sliding movement over pins 19 in a direction parallel to the longitudinal direction of the screw spindle, which pins are threaded at one end and which are screwed into threaded holes in plate 8 with said threaded end. On their side remote from plate 8 the pins are formed with heads 20, which prevent nut-shaped member 18 from sliding off pins 19.

Plate springs 21 surrounding screw spindle 6 are disposed between nut-shaped element 18 and plate 8.

A bush 22 is attached to the nut-shaped member on the side remote from plate springs 21, which bush is closed at the end remote from the nut-shaped member. Said bush surrounds the end of the screw spindle 6 that projects from the nut-shaped member, and preferably it will be filled with grease. In this manner this end of the screw spindle projecting from the nut-shaped member is protected against fouling, whilst it will also be lubricated by the grease that is present inside the bush.

The part of the screw spindle that extends between the split locking ring 15 and the plate 8 is surrounded by a bellows 23 made of rubber or a similar resilient material, so that also that part of the screw spindle will be protected against fouling.

Furthermore two guide pins 24 extending parallel to each other are secured to the ends of the guide pins 24 remote from connecting wedge 10 by means of bolts 26.

The guide pins 24 extend through holes 27 formed in the fixed link 4 and through chambers 28 contiguous thereto, which are recessed in fixed link 4. The outside diameters of the rings 26 are such that they are indeed capable of movement within chambers 28 but incapable of movement through holes 27, as will be apparent in particular from FIG. 2.

Figure 2:
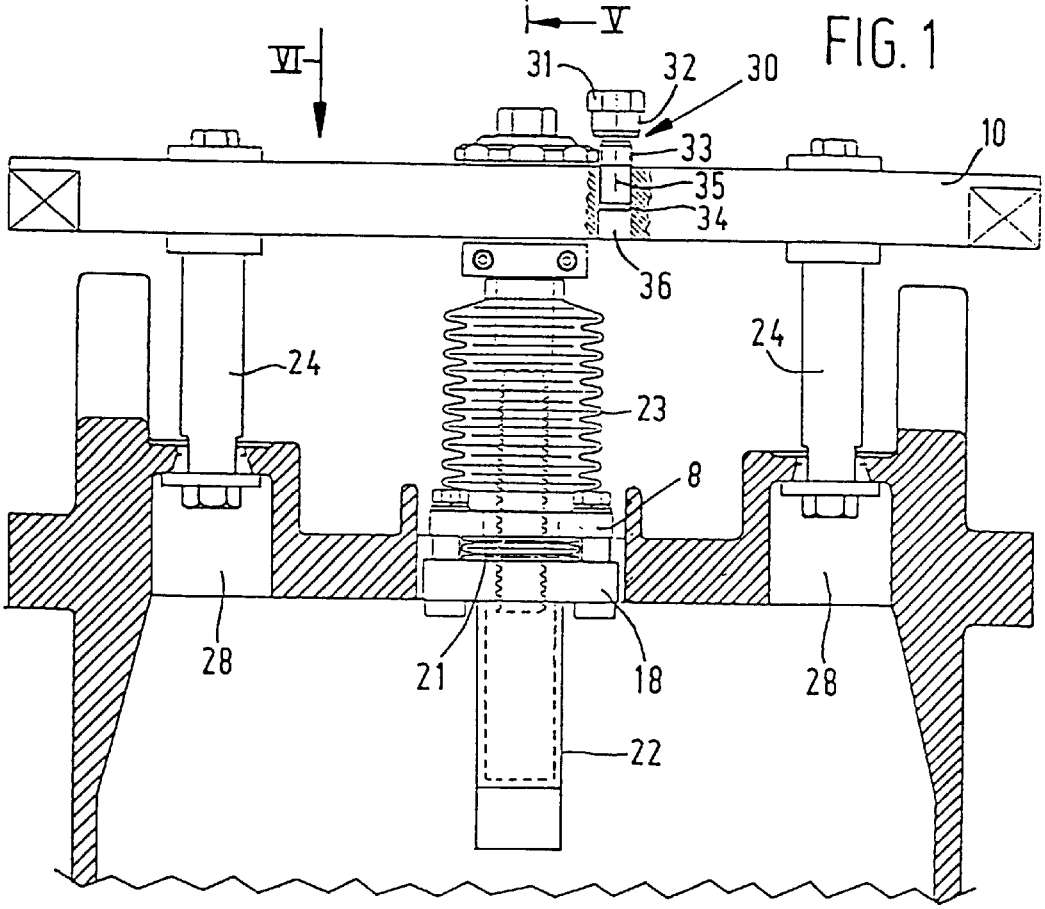
FIG. 2 is a similar view, showing the various parts in a position in which the connecting wedge is disconnected from the tool.
Figure 3:
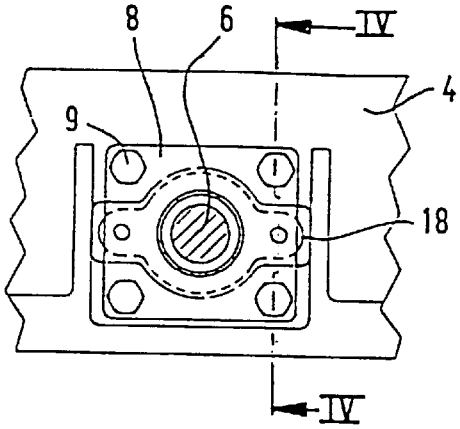
FIG. 3 is a sectional view of FIG. 1, along line III—III in FIG. 1.
Figure 4:
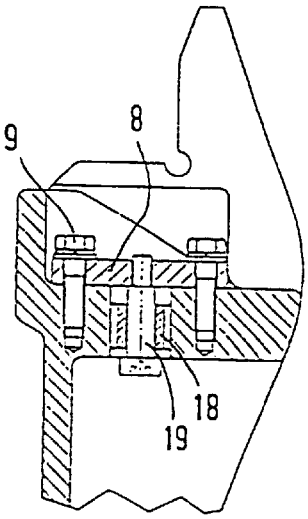
FIG. 4 is a sectional view of FIG. 3, along line IV—IV in FIG. 3.
Figure 5:
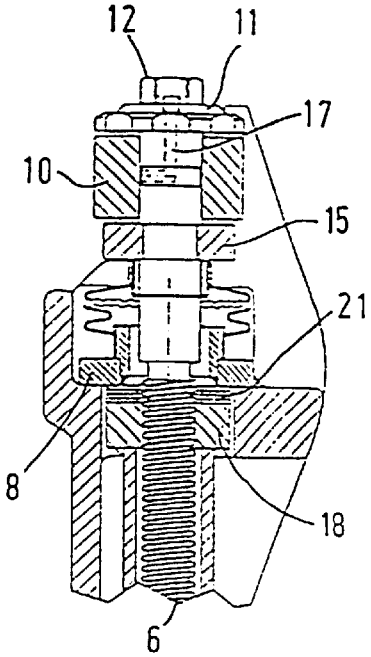
FIG. 5 is a sectional view of FIG. 1, along line V—V in FIG. 1.
Figure 6:
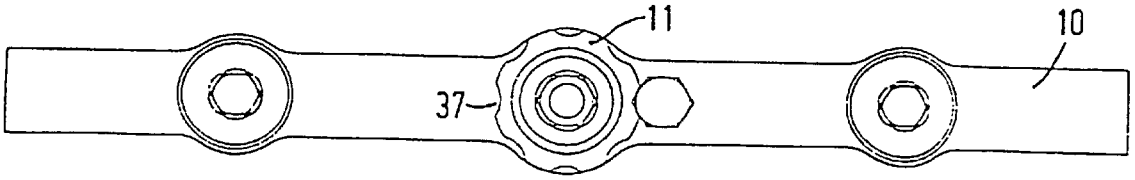
FIG. 6 is a view of FIG. 2, according to arrow VI in FIG. 2.

Said FIG. 2 shows the position which the connecting wedge takes up with respect to the connecting piece prior to linking up a tool. In this position the connecting wedge 10 is spaced a maximum distance from the connecting piece 1 by means of screw spindle 6, and the connecting piece can be coupled to a tool, as is also described in European patent No. 0 521 560. Then, in order to lock the connecting piece in position, the screw spindle 6 will be rotated by means of a wrench which is slipped over the nut-shaped member 12 so as to move the connecting wedge 10 in the direction of the connecting piece, thereby causing the ends of the connecting wedge to engage in corresponding recesses formed in the tool to be linked up.

The plate springs 21, which have urged plate 8 and nut-shaped member 18 as far apart as possible in the position of the various parts shown in FIG. 2, will be compressed thereby.

By using said springs an adequate clamping action of the connecting wedge 10 will be maintained once the connecting wedge 10 is clamped down on the tool to be linked up and the tool is put into operation, also when the connecting wedge will "settle" slightly in use in the recesses formed in the tool, in which the ends of the connecting wedge are accommodated.

In order to prevent rotation of the screw spindle 6 during operation, a locking member 30 is provided, which includes a bolt head 31 and a shaft joining said head, which comprises a shaft portion 32 adjoining head 31 and which furthermore comprises two threaded portions 33 and 34, which are interconnected by a shaft portion 35, whose outside diameter is smaller than that of threaded portions 33 and 34. Locking member 30 is disposed in a bore 36 formed in wedge 10, which is only internally threaded along part of its length.

Recesses 37 are formed in the outer circumference of the plate-shaped part for cooperation with locking member 30.

In the position of the locking member which is shown in FIG. 2, the threaded portion 33 of the locking member has been screwed out of hole 36, whilst the threaded portion 34 of locking member 30 is still positioned under the internally threaded portion of hole 36, that is, in the nonthreaded portion of said hole 36. The nonthreaded portion of hole 36 thereby has a larger diameter than the threaded portion of hole 36. In this position of the locking member it is possible to rotate screw spindle 6. In order to lock screw spindle 6 against rotation, the threaded portion 33 of locking member 30 will be screwed into hole 36, wherein the shaft portion 32, which has a larger outside diameter than the threaded portion 33, will come to lie in one of the recesses 37 in plate-shaped part 11 and lock screw spindle 6 against rotation.

The above-described construction of locking member 30 comprising two spaced-apart, threaded portions 33 and 34 prevents easy loss of locking member 30 upon being loosened for the purpose of allowing rotation of screw spindle 6. After all, once the threaded portion 33 has been screwed out of hole 36, the threaded portion 34 will first have to be brought into engagement with the internally threaded portion of hole 36 in order to remove the locking member 30 completely.

What is claimed is:

1. A connecting piece which can be pivotally connected both to the jib of an excavator and to a setting cylinder connected to a jib, and which is intended for linking up to a tool, such as an excavator bucket, for example, to the end of the jib, wherein a connecting wedge is connected to the connecting piece, in which two pins extending perpendicularly to the longitudinal direction of the wedge and being guided in the connecting piece are mounted, whilst an adjusting element is connected to the connecting piece, by means of which the connecting wedge can be moved a specific distance with respect to the connecting piece in a direction parallel to the longitudinal direction of said pins, and wherein the connecting piece comprises a screw spindle having a central axis, which is rotatable about the central axis and which is journalled in the connecting wedge in such a manner as to be incapable of movement in its longitudinal direction and which is screwed into a nut-shaped member connected to the connecting piece, which nut-shaped member can spring in the longitudinal direction of the screw spindle with respect to the connecting piece.

2. A connecting piece according to claim 1, wherein the screw spindle is surrounded by a few plate springs, which are confined between the nut-shaped member and a part of the connecting piece.

3. A connecting piece according to claim 1 or 2, wherein a bush surrounding the screw spindle is connected to the nut-shaped member on the side of the nut-shaped member remote from the connecting wedge.

4. A connecting piece according to claim 1, wherein a portion of the screw spindle positioned between the connecting wedge and the nut-shaped member is surrounded by a bellows consisting of a resilient material.

5. A connecting piece according to claim 1, wherein a locking member is provided, by means of which the screw spindle can be locked against rotation.

6. A connecting piece according to claim 5, wherein said locking member is mounted on the connecting wedge.

7. A connecting piece according to claim 6, wherein said locking member includes a shaft, which comprises a threaded portion, which is screwed into an internally threaded hole formed in the connecting wedge, and a shaft portion which has a larger diameter than the threaded portion and which can be placed into one of the recesses formed in the outer circumference of a plate-shaped part connected to the screw spindle.

8. A connecting piece according to claim 7, wherein the shaft of the locking member includes two spaced-apart, threaded portions, whilst the hole formed in the connecting wedge is only threaded along part of its length.

* * * * *